US009028668B2

(12) United States Patent
Isono et al.

(10) Patent No.: US 9,028,668 B2
(45) Date of Patent: May 12, 2015

(54) ELECTROLYTIC COPPER PLATING BATH AND METHOD FOR ELECTROPLATING USING THE ELECTROLYTIC COPPER PLATING BATH

(75) Inventors: Toshihisa Isono, Hirakata (JP); Naoyuki Omura, Hirakata (JP); Koji Shimizu, Hirakata (JP); Shinji Tachibana, Hirakata (JP)

(73) Assignee: C. Uyemura & Co., Ltd, Osaka-Shi, Osaka (JP)

( * ) Notice: Subject to any disclaimer, the term of this patent is extended or adjusted under 35 U.S.C. 154(b) by 896 days.

(21) Appl. No.: 12/840,564

(22) Filed: Jul. 21, 2010

(65) Prior Publication Data

US 2011/0062029 A1 Mar. 17, 2011

(30) Foreign Application Priority Data

Sep. 16, 2009 (JP) ..... 2009-215026

(51) Int. Cl.
*C25D 3/38* (2006.01)
*C25D 5/02* (2006.01)

(52) U.S. Cl.
CPC ... *C25D 3/38* (2013.01); *C25D 5/02* (2013.01)

(58) Field of Classification Search
CPC ..... C25D 3/38; C25D 3/40
USPC ..... 205/291, 297, 298, 118
See application file for complete search history.

(56) References Cited

U.S. PATENT DOCUMENTS 6,425,996 B1 * 7/2002 Dahms et al. ..... 205/298
7,220,347 B2 * 5/2007 Isono et al. ..... 205/118

* cited by examiner

*Primary Examiner* — Luan Van
*Assistant Examiner* — Louis Rufo
(74) *Attorney, Agent, or Firm* — Haverstock & Owens LLP

(57) ABSTRACT

For use for a circuit board where a through hole and a blind via hole co-exist, an electrolytic copper plating bath in which the covering power for the through hole and the plugging performance for the blind via hole are sufficient, and an electroplating method that uses the electrolytic copper plating bath, are disclosed. The electrolytic copper plating bath is mainly composed of a water-soluble copper salt, sulfuric acid and chloride ions. A polyamide polyamine, obtained on processing by heating of an epichlorohydrin modified product of a polycondensation product of diethylene triamine, adipic acid and ϵ-caprolactam, is contained in the bath as a leveler.

16 Claims, 8 Drawing Sheets

ELECTROLYTIC COPPER PLATING BATH AND METHOD FOR ELECTROPLATING USING THE ELECTROLYTIC COPPER PLATING BATH

BACKGROUND OF THE INVENTION

1. Field of the Invention

This invention relates to an electrolytic copper plating bath and to an electroplating method that uses it. More particularly, it relates to the electrolytic copper plating bath that may be applied with advantage to a circuit board where blind via holes and through holes exist together, and the method for electroplating using the electrolytic copper plating bath.

2. Description of Related Art

As the electronic components are becoming smaller in size, an increasing demand has been raised towards elevating their integration degree. To meet such demand, the packaging method is transitioning from peripheral terminal or area terminal packaging towards three-dimensional packaging. For this reason, attempts are being made to provide for current conduction to or connection of a semiconductor chip or an interposer by a through-electrode. As in the copper damocene process or in via filling for a printed circuit board, a need is felt for filling a blind via hole with a copper plating film by electrolytic copper plating.

On the other hand, a printed circuit board having both a through hole and a blind via hole has come into use. With the through hole, a copper plating film is formed on the inner wall surface of the hole and, with the blind via hole, copper plating is introduced into the inside of the hole by way of via-filling. It has thus become necessary to effect via-filing and plating of a through hole simultaneously.

However, in case the plating bath of the related technique, aimed at via-filling, is used for through hole plating, the film thickness at the through hole corner becomes unusually thin, thus possibly causing the corner crack. The plating bath of the related technique may thus not be usable for through hole plating. On the other hand, with the plating bath aimed at through hole plating, such as that proposed in the technique shown in Patent Publication 1, the film thickness at the inner bottom of the blind via hole becomes thin, such that it is difficult to fill the blind via hole with a copper plating precipitate. Hence, a need is felt for a plating bath with which the blind via hole and the through hole may be plated simultaneously.

PUBLICATION OF RELATED TECHNIQUE

Patent Publication

[Patent Publication 1]JP Patent Laid-Open Publication 2003-321792

SUMMARY OF THE INVENTION

Problem to be Solved by the Invention

In view of the above status of the related technique, it is desirable to provide an electrolytic copper plating bath, and a method for electroplating, for a circuit board where a blind via hole and a through hole co-exist, according to which plating may be performed with the sufficient plugging performance for the blind via hole and with the sufficient covering power for the through hole.

Means to solve the Problem

The present invention has been arrived at through our eager scrutiny into the above mentioned status of the related technique. The present invention is based on the finding that, by using an electrolytic copper plating bath containing, as a leveler, a polyamide polyamine compound, it is possible to perform the processing of plating with the sufficient covering power for the through hole and with the sufficient plugging performance for the blind via hole. This polyamide polyamine compound may be prepared by processing by heating of an epichlorohydrin modified product of a polycondensation product of diethylen triamine, adipic acid and ϵ-caprolactam. The polyamide polyamine compound is straight-chained and is free from quaternary nitrogen as well as from tertiary amide structure.

That is, the present invention is an electrolytic copper plating bath containing a water-soluble copper salt, sulfuric acid and chloride ions, as main components, and a compound represented by the following chemical formula (1)

(1)

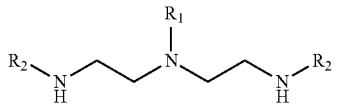

in which $R_1$ is represented by the following chemical formula (2) or (3):

$R_1$:

(2)

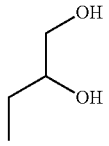

(3)

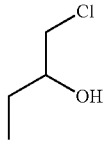

$R_2$ is represented by the following chemical formula (4)

$R_2$:

(4)

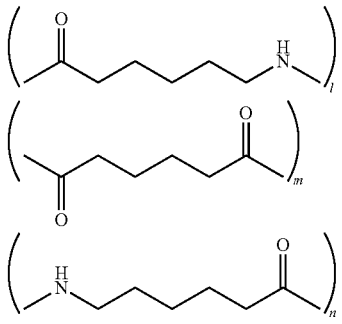

l denotes an integer not less than 0;

m denotes 1; and n denotes an integer not less than 0.

The compound represented by the chemical formula (1) may be prepared by processing by heating of a compound represented by the following chemical formula (5):

(5)

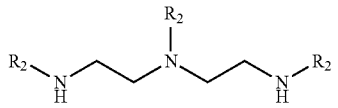

The compound represented by the chemical formula (5) is an epichlorohydrin modified product of a polycondensation product of diethylene triamine, adipic acid and ϵ-caprolactam.

The electrolytic copper plating bath may further contain a sulfur-containing compound selected from the group consisting of compounds of the chemical formulas (6) to (9):

(6)

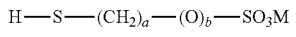

(7)

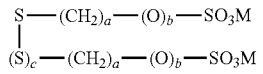

(8)

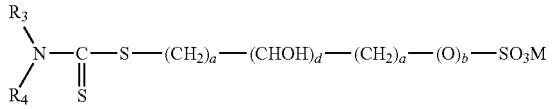

(9)

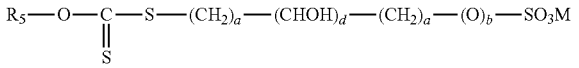

where $R_3$, $R_4$ and $R_5$ denote alkyl groups with 1 to 5 carbon atoms, M denotes a hydrogen atom or an alkali metal, a denotes integers from 1 to 8, and b to d each denote 0 or 1.

The electrolytic copper plating bath may further contain a polyalkylene glycol represented by the chemical formula (10):

$$HO—(R_6—O)_e—H \quad (10)$$

where $R_6$ denotes an alkylene group having two or three carbon atoms and e denotes an integer not less than four, or a derivative thereof.

The polyethylene glycol is polyethylene glycol, polypropylene glycol or a copolymer of ethylene glycol and propylene glycol.

A method for electrolytic copper plating according to an embodiment of the present invention comprises immersing an article to be plated, having both a through hole and a blind via hole, in an electrolytic copper plating bath as described above, and carrying out electroplating, with the article as a cathode, to effect plating the inside of the through hole and the inside of the blind via hole simultaneously.

Effect of the Invention

With the electrolytic copper plating bath, and the electroplating method that uses the electrolytic copper plating bath, according to the embodiment of the present invention, it is possible to effect plating processing for a circuit board having both the blind via hole and the through hole. The plating achieved is sufficient in the plugging property for the blind via hole and in the covering power for the through hole.

DESCRIPTION OF THE PREFERRED EMBODIMENTS

Figure 1:
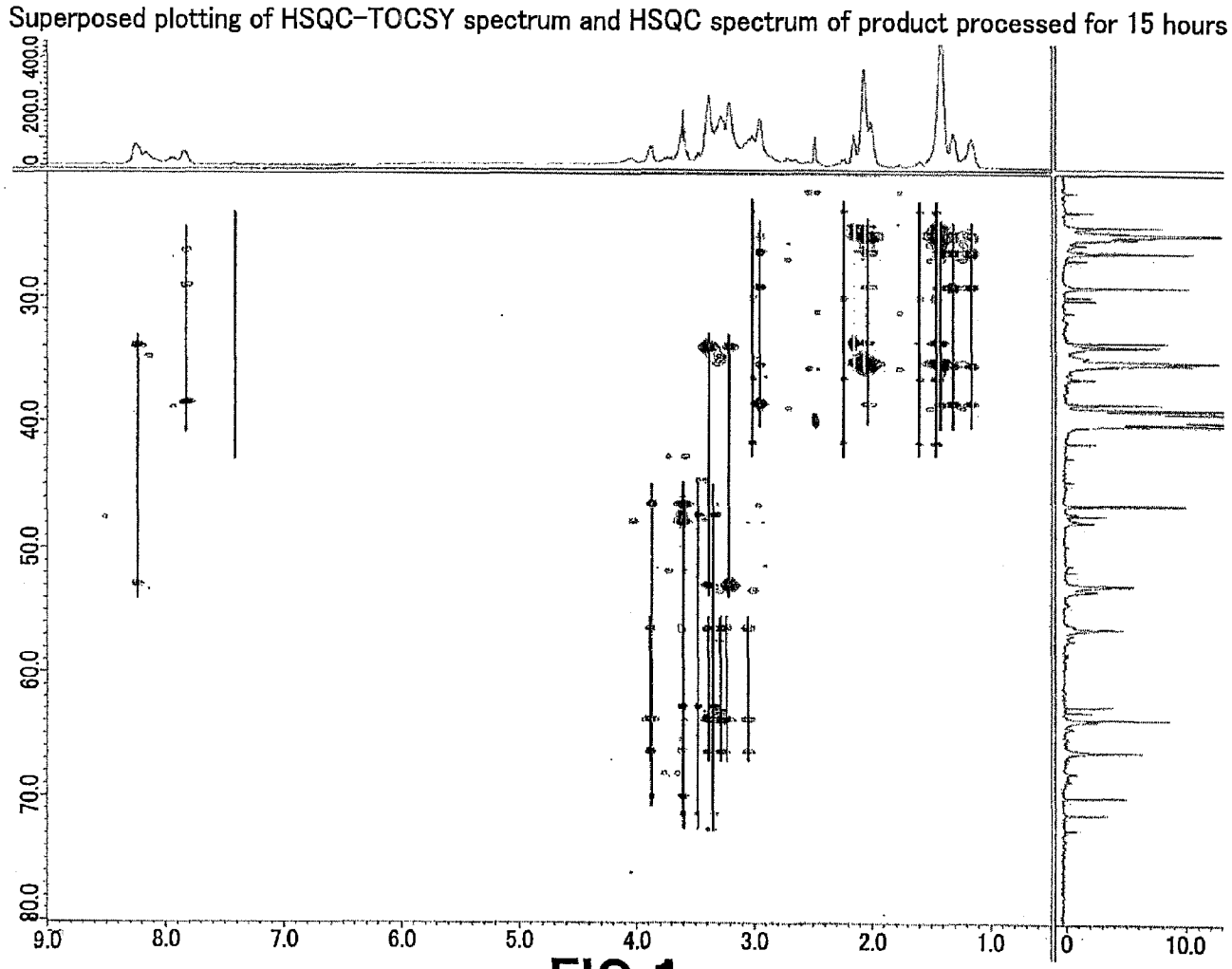
FIG. 1 is a chart showing the HSQC-TOCSY spectrum and the HSQC spectrum for the compound, obtained on processing by heating for 15 hours, in which the spectrums are plotted superposed together.

In the following, a certain concrete embodiment of the present invention will be explained in detail. Initially, an electrolytic copper plating bath according to a preferred embodiment will be explained in detail.

An electrolytic copper plating bath according to the present embodiment contains a water-soluble copper salt, sulfuric acid and a chloride ion as essential components. The present electrolytic copper plating bath also contains, as a leveler, a polyamide polyamine compound having a straight-chained structure free of quaternary nitrogen and also free of a tertiary amide structure. This polyamide polyamine compound has been prepared by processing by heating of an epichlorohydrin modified product of a polycondensation product composed of diethylene triamine, adipic acid and ϵ-caprolactam.

The water-soluble copper salt is contained as a copper ion supply source and may be exemplified by salts of copper compounds, such as copper sulfate, copper chloride, copper oxide, copper carbonate, copper pyrophsophate, copper borofluoride, copper methanesulfonate, copper propanesulfonate, copper isethionate and copper propanolsulfonate. These copper compounds may be used either alone or in combination. In case the copper salt is copper sulfate, the concentration of the water-soluble copper salt in a copper plating bath is preferably 30 to 300 g/L as copper sulfonate pentahydrate.

Sulfuric acid and chloride ions are also contained in the electrolytic copper plating bath. Specifically, sulfuric acid is contained at a concentration of 30 to 300 g/L, while chloride ions are contained at a concentration of 5 to 150 mg/L, preferably 20 to 100 mg/L. If the chloride ion concentration exceeds 150 mg/L, there is a risk that copper chloride is generated on an anode surface to impassivate the anode, whereas, if the chloride ion concentration is less than 5 mg/L, a suppressive action may be in play only partially, thus possibly terracing the plated surface.

As described above, not only the above mentioned essential components but also the leveler (leveling component) is contained in the electrolytic copper plating bath of the present embodiment. The leveler, an additive composed of a nitrogen-containing compound, operates as cations in an acidic plating bath, and acts in an electrically condensed fashion on a site of a high electrical current density, such as on the surface of a via or a through hole in an article being plated. The activation over-voltage may thus be increased to suppress copper precipitation. On the other hand, the leveler is adsorbed in a lesser quantity in a bottom portion of a fine groove or hole to prioritize copper precipitation. Thus, the leveler exhibits the leveling performance by setting up a state of bottom-up precipitation.

The leveler contained in the electrolytic copper plating bath according to the present embodiment is a polyamide polyamine compound represented by the following chemical formula (1):

(1)

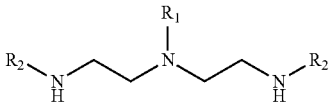

In the above chemical formula (1), $R_1$ is represented by the chemical formula (2) or (3):

$R_1$:

(2)

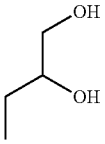

or (3)

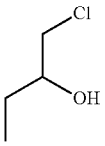

while $R_2$ is represented by the chemical formula (4)

$R_2$:

(4)

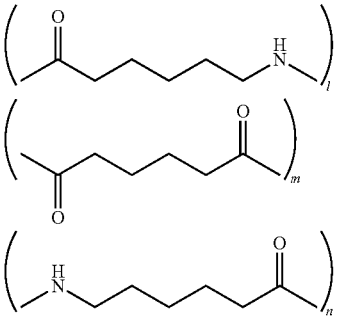

where l denotes an integer not less than 0, m denotes 1 and n denotes an integer not less than 0.

The polyamide polyamine compound, contained as the leveler, has a straight-chained structure, as indicated by the above formula (1). It is thus a compound not having quaternary nitrogen or tertiary amide structure and having a tertiary amine structure and a secondary amide structure. The polyamide polyamine compound, represented by the above formula (1), is prepared by processing by heating of a compound represented by the following formula (5):

(5)

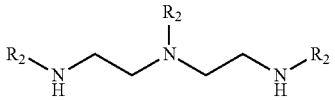

The compound represented by the formula (5) is an epichlorohydrin modified product. Viz., it is prepared by modifying a polycondensation product, composed of diethylene triamine, adipic acid and c-caprolactam, by epichlorohydrin.

Specifically, the epichlorohydrin modified product may be prepared by the following method. Viz., diethylene triamine and adipic acid are reacted with each other for condensation in the presence of ϵ-caprolactam, thereby yielding polyamide amine. This polyamide amine prepared is mixed homogeneously with epichlorohydrin in an aqueous solution. By addition of epichlorohydrin, a polyamide polyamine compound, which is an epichlorohydrin modified product, may be generated.

In this manner, the epichlorohydrin modified product may be prepared in, for example, a two-stage reaction. In the first stage, 1 to 4 mols of diethylene triamine are reacted per mol of adipic acid, referred to above, for condensation. This reaction of condensation is carried out in the presence of c-caprolactam at a reaction temperature of 70 to 150° C.

In the second stage, epichlorohydrin and polyamide amine, prepared in the first stage, are mixed homogeneously in an aqueous solution and added by epichlorohydrin to yield the epichlorohydrin modified product. Meanwhile, epichlorohydrin is used at a ratio of 0.2 to 3 mols to one mol of polyamide amine for reaction.

The pH value of the reaction solution of the second stage is preferably 2.0 to 7.0 and more preferably 2.0 to 5.0. An organic or inorganic acid may be added to the reaction system to adjust the pH value. For adjusting the pH value, formic acid, acetic acid, ethanic acid, propionic acid or oxalic acid may be used as the organic acid, while hydrochloric acid, sulfuric acid or phosphoric acid may be used as the inorganic acid.

The reaction temperature up to approximately 100° C. may be used for the second stage. Preferably, the reaction temperature may be adjusted to approximately 20 to 50° C.

The reaction of the second stage is carried out as epichlorohydrin is added to an aqueous solution of polyamide amine. An organic or inorganic acid may be added to the reaction system. The concentration of polyamide amine in a range from 20 to 60 wt % is preferred.

The reaction of the second stage is continued until there is no epichlorohydrin left non-reacted. The reaction time is changed suitably depending on the sorts of reactants used, and may, for example, be approximately five minutes to approximately three hours.

The leveler contained in the electrolytic copper plating bath in the present embodiment may be prepared by processing by heating of the modified epichlorohydrin product of the polycondensation product represented by the above formula (5).

When processed by heating, as described above, the compound represented by the above formula (5) undergoes modification in which the site of the tertiary amide structure of the compound (5) is turned into a tertiary amine structure, as indicated by the formulas (1) to (4). With the modification, the molecular weight becomes smaller. Viz., by processing by heating of the compound (5) having the tertiary amide structure and the secondary amide structure, the compound (1) having the tertiary amine structure and the secondary amide structure is generated.

There is no particular limitation to the method for processing by heating used provided that the method used is a refluxing processing of boiling a solvent or a processing by heating of the modified epichlorohydrin at a constant temperature lower than the boiling temperature of the solvent. Preferably, a well-known refluxing processor may be used to prevent water as a solvent from being vaporized and lost in the course of the processing by heating.

There is no limitation to the processing temperature in the course of processing by heating. However, the higher relatively the heating temperature, the shorter may be the heating time. Hence, the heating temperature is preferably not lower than approximately 93° C. and more preferably not lower than approximately 96° C. If the heating temperature is lower than approximately 93° C., the rate of reaction becomes lower, and hence a longer processing time is needed. Meanwhile, the upper limit of the heating temperature is the temperature for refluxing processing, viz., the boiling temperature of the solvent.

The processing temperature for processing by heating is preferably approximately 10 to 20 hours. If the heating or refluxing temperature is shorter than approximately ten hours, there still persists the site of the tertiary amide structure in the modified epichlorohydrin product, resulting in inferior plugging performance for the blind via holes. If the heating time is longer than approximately 20 hours, the reaction in its entirety has come to a close. The plugging performance for the blind via hole may thus no longer be improved, resulting in wasteful processing and inferior efficiency.

The electrolytic copper plating bath according to the embodiment of the present invention thus uses the above compound (1) as a leveler. This compound (1) is obtained by processing by heating of the epichlorohydrin modified product, represented by the compound of the chemical formula (5) having the tertiary amide structure. By this processing by heating, the tertiary amide structure of the compound (5) is turned into a tertiary amine structure. The compound (1), whose structure has thus been changed from the starting state, is improved in its cationic property, while its molecular structure is turned from a networked structure into a linear one. The leveler, composed of the compound (1), is improved in its performance in suppressing copper precipitation on the board portions exhibiting a higher current density, such as board surface portions, protuberances or entrances to vias. As a result, in the electrolytic copper plating bath containing the compound (1) as a leveler, according to the present invention, it is possible to improve the plugging performance for blind via holes.

Moreover, the electrolytic copper plating bath according to the embodiment of the present invention may be used with advantage for a circuit board having both blind via holes and through holes (a circuit board where the blind via holes and the through holes exist together) for plugging the blind via holes and plating the through holes simultaneously. Viz., it is possible to improve the plugging performance for blind via holes and provide for an optimum coverage power for through holes.

In plating the circuit board where the blind via holes and the through holes exist together, there is no limitation to the diameter or to the aspect ratio of the blind via holes. Viz., the present invention may be applied with advantage to a circuit board where the blind via holes and the through holes exist together, with the diameter of the blind via holes being preferably 10 to 200 μm and more preferably 20 to 100 μm and with the aspect ratio (hole depth/hole diameter) being preferably not less than 0.3 and preferably in a range between 0.5 to 1.

There is also no limitation to the shape of the blind via hole being processed, such that blind via holes having a circular or elliptical cross-section or blind via holes having a polygonally-shaped cross-section, such as a square-shaped cross-section, may be processed according to the present invention. In setting the aspect ratio, such a diameter corresponding to the shortest one of a plurality of straight lines passing through the center of gravity and interconnecting two optional points on the outer periphery of the hole in question is to be used.

In the electrolytic copper plating bath according to the present embodiment, the leveler represented by the chemical formula (1) has a concentration preferably of 0.01 to 10000 mg/L and in particular of 1 to 100 mg/L. If the leveler has a concentration lower than 0.01 mg/L, the copper precipitation suppression effect on the circuit board surface falls short. On the other hand, if the leveler has a concentration has a concentration higher than 10000 mg/L, the amount of the leveler deposited on the blind via hole bottom is increased to suppress copper precipitation, such that it is not possible to achieve optimum via filling.

It is moreover desirable to add a brightener, as an accelerator for nucleation, to the electrolytic copper plating bath according to the present embodiment. By using the leveler and the brightener in combination, plating is preferentially from the via bottom side, under the synergistic effect of the plating suppressing effect by the leveler and the plating promoting effect by the brightener. It is noted that the plating suppressing effect by the leveler acts on a board surface part of the via, viz., an upper extreme end of the lateral surface of the via, while the plating promoting effect by the brightener acts at a mid part of the blind via hole. In this manner, the blind via hole may positively be filled with copper plating without producing voids. The brightener preferably contains one or more of compounds selected from the group of sulfur-containing compounds shown by the following chemical formulas (6) to (9):

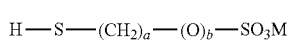

(6)

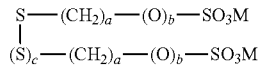

(7)

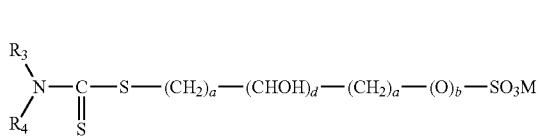

(8)

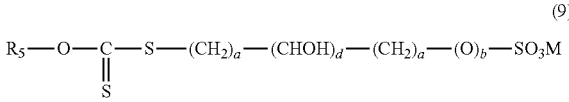

(9)

In the above chemical formula, $R_3$, $R_4$ and $R_5$ each denote an alkyl group having 1 to 5 carbon atoms, preferably a methyl group or an ethyl group. $R_3$, $R_4$ and $R_5$ may be the same or different from one another. M denotes a hydrogen atom or an alkali metal, such as sodium or potassium. In the above chemical formula, a denotes an integer from 1 to 8, preferably from 1 to 5 and most preferably 3, and b, c and d each denote 0 or 1.

Specifically, any one of the compounds represented by the following chemical formulas (11) to (14):

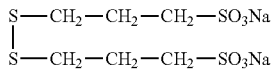

(11)

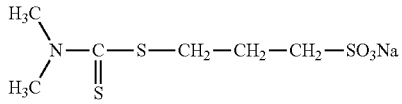

(12)

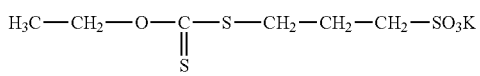

(13)

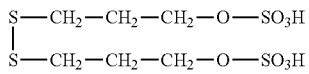

(14)

may be used as the brightener.

The concentration of the brightener in the electrolytic copper plating bath of the present embodiment is preferably 0.01 to 100 mg/L and more preferably 0.1 to 30 mg/L.

In the electrolytic copper plating bath of the present embodiment, it is desirable to add a carrier, as a nucleation suppressor, in addition to the leveler and the brightener. By adding the carrier to the bath, it is possible to exploit a broader concentration range of the leveler due to the suppression effect brought about by the carrier. Specifically, plating proceeds preferentially from the blind via hole bottom side, even though the leveler concentration is lowered. This renders it possible to fill the blind via hole positively with copper plating without producing voids. Preferably, the carrier contains polyalkylene glycol represented by the following chemical formula (10):

$$HO—(R_6—O)_e—H \quad (10)$$

In the above chemical formula, $R_6$ denotes an alkylene group with two or three carbon atoms (an ethylene group or a propylene group) and $R_6$ may be the same or different. In the above chemical formula, e denotes an integer not less than four and preferably in a range from 10 to 250.

Polyalkylene glycol, referred to above, may be any one of polyethylene glycol, polypropylene glycol and an ethylene glycol/propylene glycol copolymer. The average molecular weight (weight-averaged molecular weight) of polyalkylene glycol is preferably not less than 200 and more preferably in a range of 500 to 15000.

The carrier in the electrolytic copper plating bath according to the present embodiment has a concentration preferably in a range from 0.001 to 2000 mg/L and more preferably in a range from 50 to 500 mg/L.

In the present embodiment, blind via holes and through holes, formed in a circuit board, as an article to be plated, are plated, using the above mentioned electrolytic copper plating bath. There is no particular limitation to the sorts of the circuit board as the article to be plated, such that any board, e.g., a copper-clad polyimide board, a copper-clad polyester board, copper-clad polyether imide board, copper-clad liquid crystal polymer board, a copper-clad phenolic board, a copper-clad paper epoxy board, a copper-clad paper polyester board or a copper-clad glass polyimide board, may be used with advantage for the present embodiment. It is noted that the copper-clad phenolic board may be composed of a thermo-setting resin and a base material formed by a glass cloth, a glass mat or synthetic fibers. The circuit board may not be double-sided but may also be multilayered.

As the processing conditions for electroplating, those known so far for electroplating may be used. It is however desirable that the density of the cathode current is in a range of 0.05 to 5 A/dm$^2$ and in particular in a range of 0.5 to 3 A/dm$^2$. Stirring may be by routinely used techniques, such as aeration, a jet or a squeezee. An anode used may be one known per se. A soluble anode, such as a copper plate, or a non-soluble anode, may be used. The plating temperature is preferably 15 to 35° C. and, in particular, 22 to 28° C.

It is noted that the present invention is not limited to the above embodiment, such that design changes that do not depart from the purport of the invention are to be included within the scope of the invention.

In the above explanation, the compositions of the plating bath, the temperatures used for plating or other processing conditions, such as processing time, are given only by way of example, and may be changed as necessary.

EXAMPLES

Concrete Examples of the present invention will now be described. It is noted that these Examples are not to be interpreted as limiting the scope of the present invention.

<Structural Analyses of Epichlorohydrin Modified Product and Compound Obtained on Processing by Heating it>

The structures of the epichlorohydrin modified product and the compound obtained on processing by heating it were analyzed as will be explained in detail below. Initially, the epichlorohydrin modified product was synthesized as follows:

9.7 g of water were charged at ambient temperature (20 to 30° C.) into a vessel. 58 g of ϵ-caprolactam were charged therein under stirring, and the reaction system was heated to 30 to 35° C. 37.8 g of adipic acid were added to the resulting solution under agitation. The resulting reaction system was heated to approximately 115 to 122° C. under refluxing and kept for two hours. The bath temperature was then cooled to approximately 100° C. (100 to 110° C.). As the temperature was kept, 52.9 g of diethylene triamine were added to the reaction system within one hour. By introducing the respective compounds in this manner, a solution low in viscosity and slightly turbid in yellowish color was prepared. The solution prepared was refluxed at 128 to 130° C. and kept for one hour. After the solution was kept for one hour, it was cooled to approximately 70° C. (65 to 75° C.).

74.8 g of adipic acid were added to the resulting solution within 15 minutes under stirring. The resulting system was refluxed for one hour under a temperature of 128 to 130° C. to generate a viscous solution of a yellow to brownish color. The so prepared solution was cooled to approximately 105° C. (100 to 115° C.).

26.4 g of diethylene triamine were then added to the resulting solution within one hour under the temperature condition of 100 to 115° C. for dissolution therein homogeneously.

The mixed solution, thus prepared, was charged into a distillation device. The distillation was carried out at a temperature of 125 to 140° C. under a reduced pressure of 100 to 500 mbar until a distillate has ceased to be generated. The distillate was taken out until the distillation ceased. Ultimately, 37 g of the distillate was obtained. 72.6 g of water were added to the distillate of 37 g obtained by the distillation processing. The resulting mass was transferred within 15 minutes into the original vessel and the temperature was lowered to approximately 100° C. The reaction system was stirred for one hour under a temperature condition of approximately 90° C. (80 to 90° C.) and subsequently cooled to ambient temperature. The resulting solution obtained weighed 321 g.

739 g of water were then added to the solution of 321 g thus obtained. The resulting mixture turned out to be a slightly turbid yellowish solution. 92.8 g of epichlorohydrin were added to this solution within three hours under a temperature condition of approximately 25° C. (20 to 35° C.) for mixing homogeneously. The resulting mass was stirred for six hours under a temperature condition of 45 to 50° C.

To get a solution of high preservation stability, 839 g of water and 8.1 g of concentrated sulfuric acid were added to the reaction system. The pH value of the solution was 4.9 at this time. Thus, the pH value was adjusted to 2 to 2.5 with the use of 11.2 g of concentrated sulfuric acid. The reaction system was cooled under stirring to ambient temperature to prepare the epichlorohydrin modified product. Meanwhile, the epichlorohydrin modified product prepared weighed 1987 g.

The epichlorohydrin modified product, thus prepared, in other words, the compound not processed with heating, was put to a structural analysis.

On the other hand, the epichlorohydrin modified product, prepared as described above (50 wt % aqueous solution), was heated for 15 hours in the manner as described below. The compound thus prepared on processing by heating was put to a structural analysis in similar manner. That is, the epichlorohydrin modified product prepared was charged into a three-necked flask, to which a refluxing tube and a thermometer were attached. The three-necked flask was charged into a water bath of 96° C., and stirring was performed with a stirrer. The reaction temperature of 96° C. was kept for 15 hours as from the time when the temperature of the aqueous solution in the flask reached 96° C. Processing by heating was carried out under stirring. After lapse of 15 hours, the flask was instantly charged into cold water, and cooling was made until the temperature of the aqueous solution in the flask reached 25° C. The compound prepared on processing by heating of the epichlorohydrin modified product in this manner was put to a structural analysis.

(Assignment of Structures Originating from Starting Materials)

The compound obtained on processing by heating and the compound not processed with heating were analyzed as to assignments of structures originating from starting materials based on superposed plotting of the HSQC-TOCSY spectrum and the HSQC spectrum.

Figure 2:
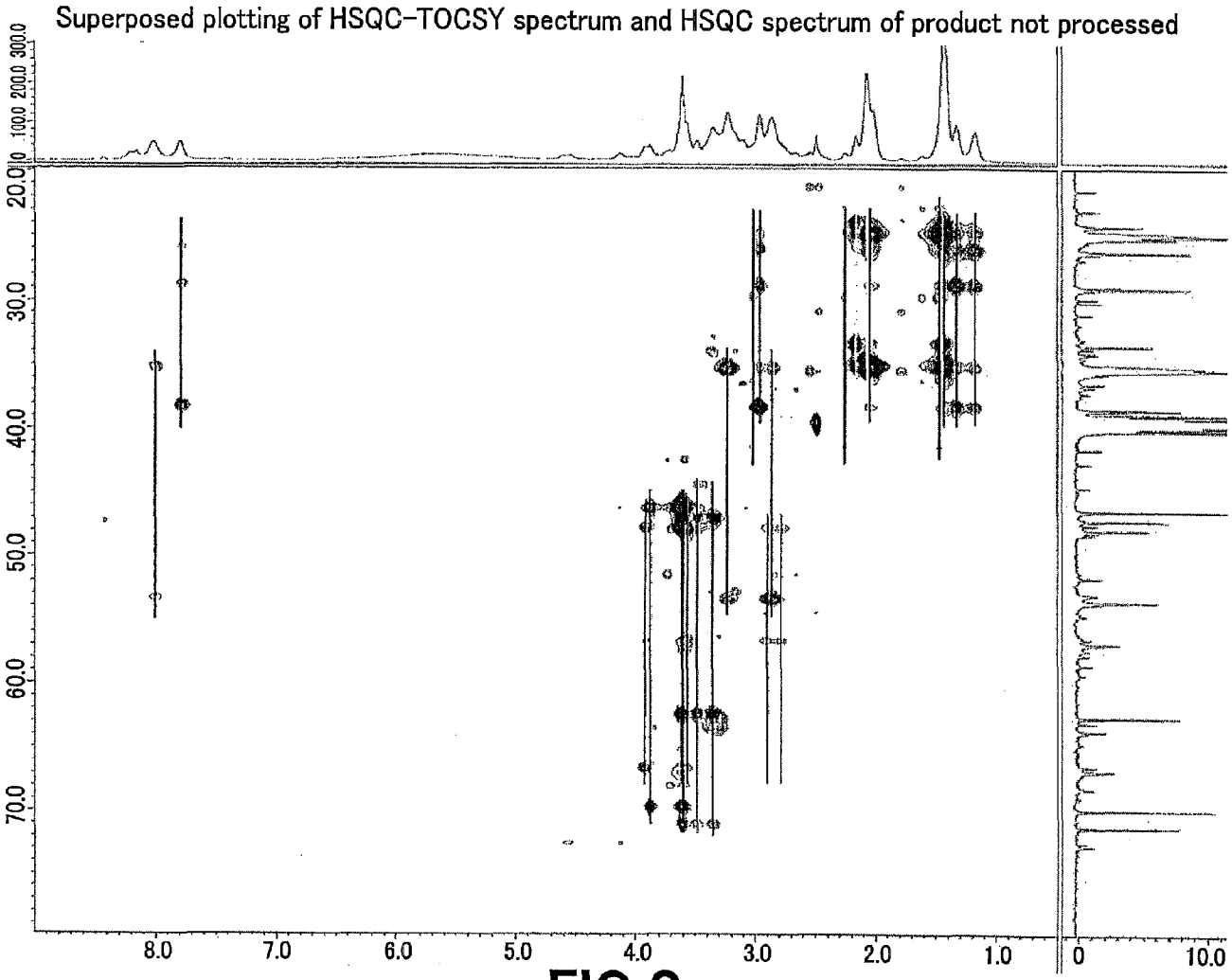
FIG. 2 is a chart showing the HSQC-TOCSY spectrum and the HSQC spectrum for the compound not processed by heating, in which the spectrums are plotted superposed together.

Table 1 below shows chemical shift. FIG. 1 depicts a graph showing superposed plotting of the HSQC-TOCSY spectrum and the HSQC spectrum for the compound obtained on processing by heating for 15 hours. FIG. 2 depicts a graph showing superposed plotting of the HSQC-TOCSY spectrum and the HSQC spectrum for the compound not processed with heating. Meanwhile, the assignment numbers of the respective starting materials correspond to numbers entered in the chemical formulas (1) to (3), (5) and (4)' indicated hereinbelow.

TABLE 1

| originating starting materials | assignment | δc (ppm) | δH (ppm) | substituents | detected/not detected: 15 hours | detected/not detected: not processed by heating |
|---|---|---|---|---|---|---|
| caprolacrum (red) | 1 | 26.2 | 1.17 | $CH_2$ | ○ | ○ |
| | 2 | 29.1 | 1.32 | $CH_2$ | ○ | ○ |
| | 3 | 25.0 | 1.43 | $CH_2$ | ○ | ○ |
| | 4 | 35.4 | 2.06 | $CH_2$ | ○ | ○ |
| | 5 | 38.4 | 2.96 | $CH_2$ | ○ | ○ |
| | A | — | 7.83 | NH | ○ | ○ |
| | 6 | 172.1 | — | C═0 | ○ | ○ |
| adipic acid (yellow 1) | 21 | 24.9 | 1.43 | $CH_2$ | ○ | ○ |
| | 22 | 35.2 | 2.08 | $CH_2$ | ○ | ○ |
| | 23 | 173.3 | — | C═0 | ○ | ○ |
| diethylene triamine (pink) | 41 | 33.9 | 3.39 | $CH_2$ | ○ | — |
| | 42 | 52.9 | 3.21 | $CH_2$ | ○ | — |
| | C | — | 8.24 | NH | ○ | — |
| diethylene triamine (pink) | 51 | 35.4 | 3.23 | $CH_2$ | — | ○ |
| | 52 | 53.7 | 2.86 | $CH_2$ | — | ○ |
| | D | — | 7.99 | NH | — | ○ |

(1)

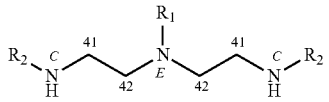

(2)

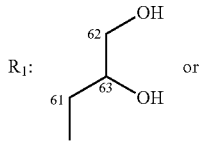

(3)

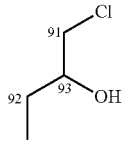

(5)

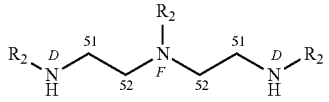

(4)'

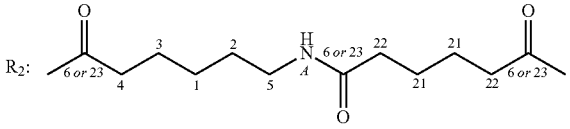

(Analyses of Reciprocal Coupling of Structures Originating from Starting Materials)

Analyses were made of the reciprocal coupling of structures originating from the starting materials, for the compound obtained on processing by heating and the compound not processed with heating, based on the HMBC spectrum and $^{15}$N-NMR spectrum.

Figure 3:
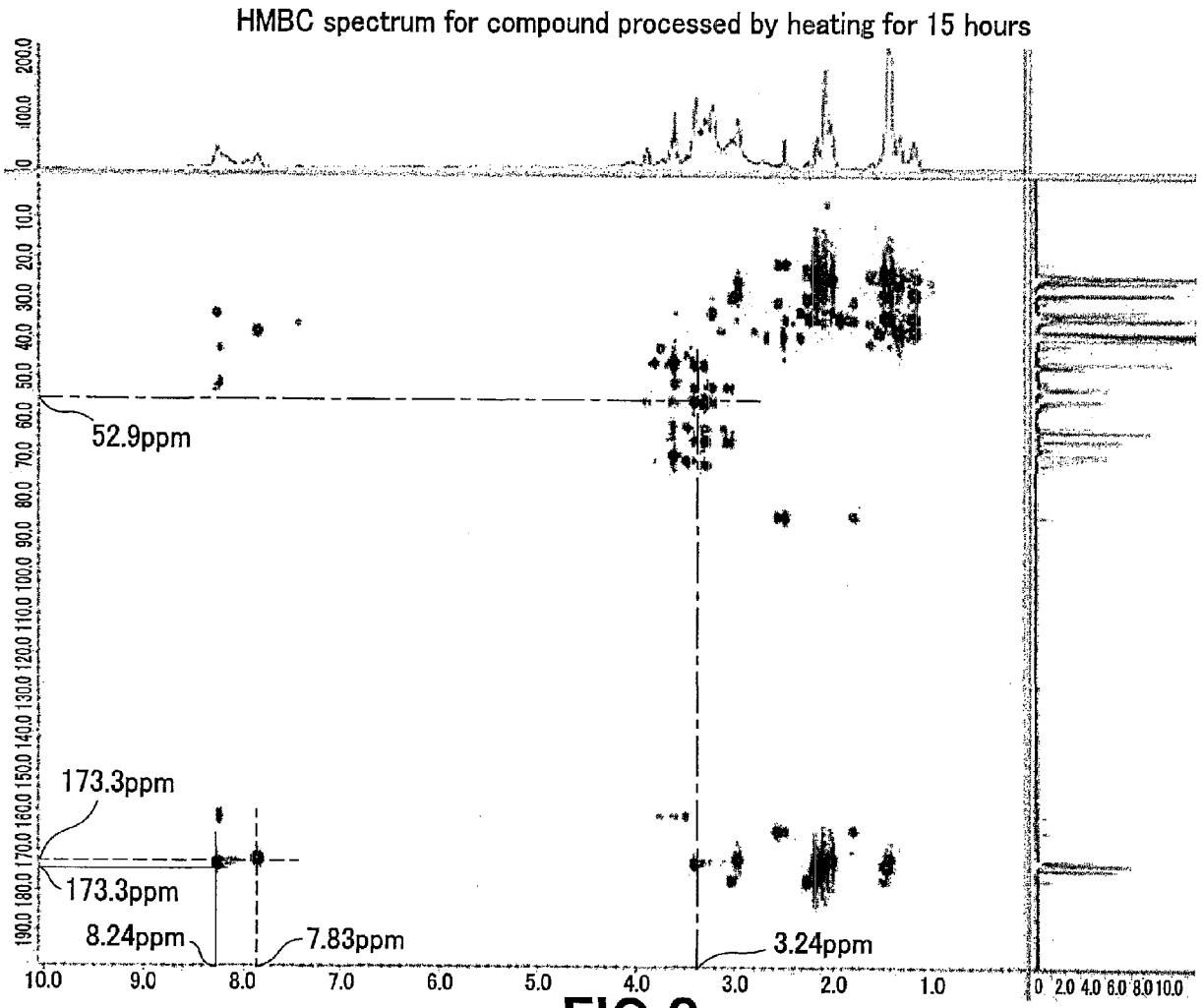
FIG. 3 is a chart showing the HMBC spectrum of the compound obtained on processing by heating for 15 hours.
Figure 4:
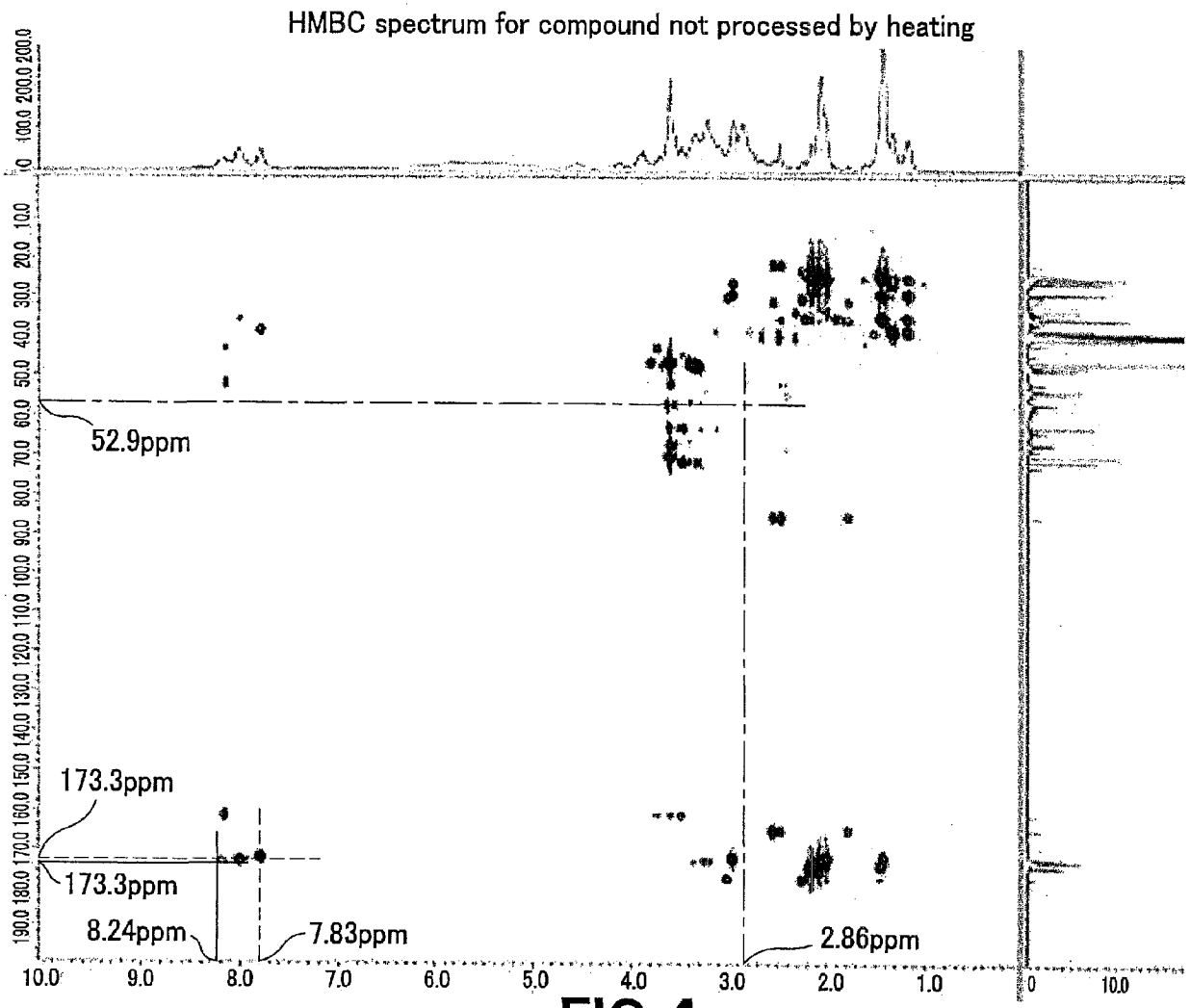
FIG. 4 is a chart showing the HMBC spectrum of the compound not processed by heating.
Figure 5:
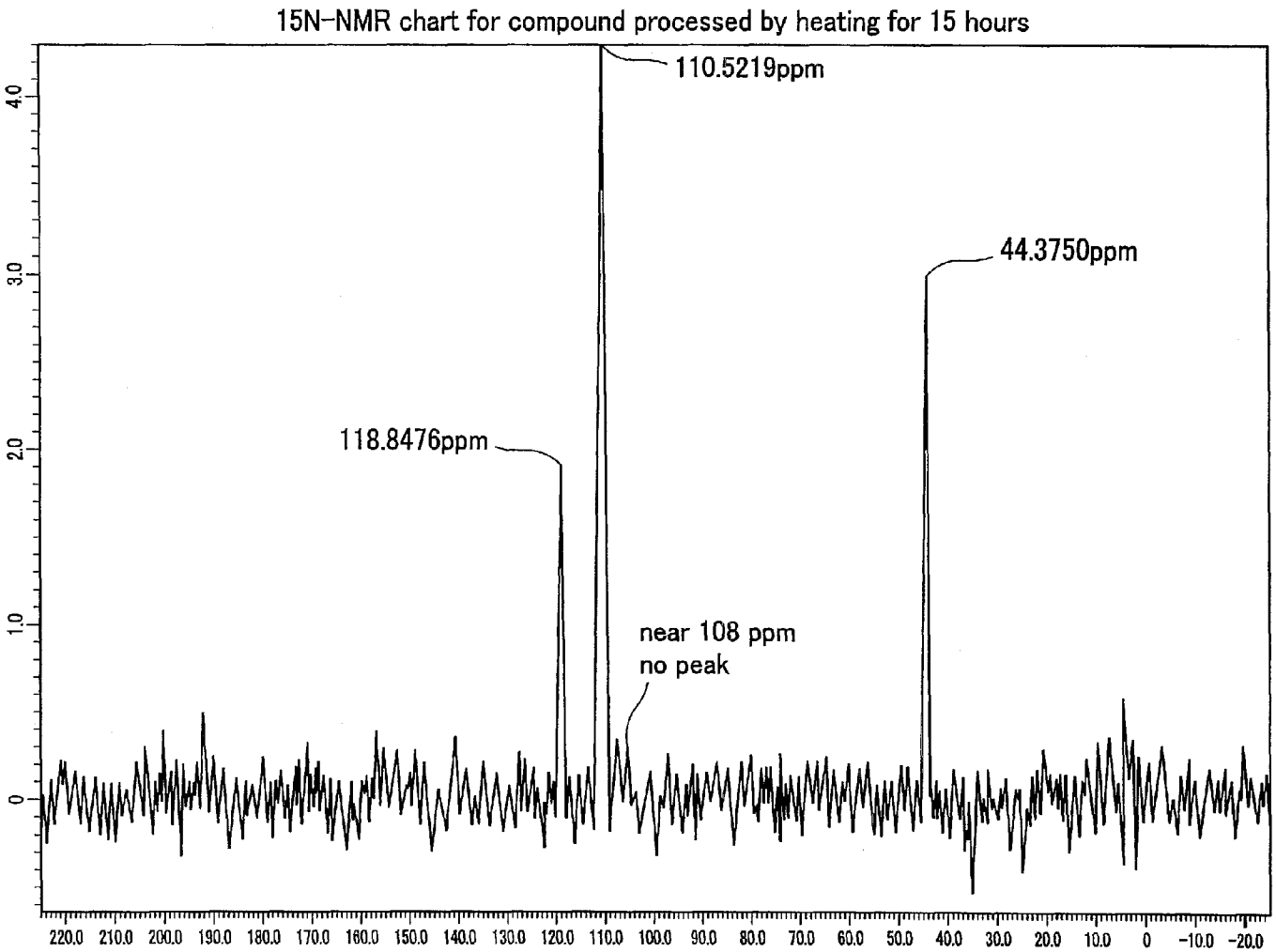
FIG. 5 is a $^{15}$N-NMR chart for the compound processed by heating for 15 hours.
Figure 6:
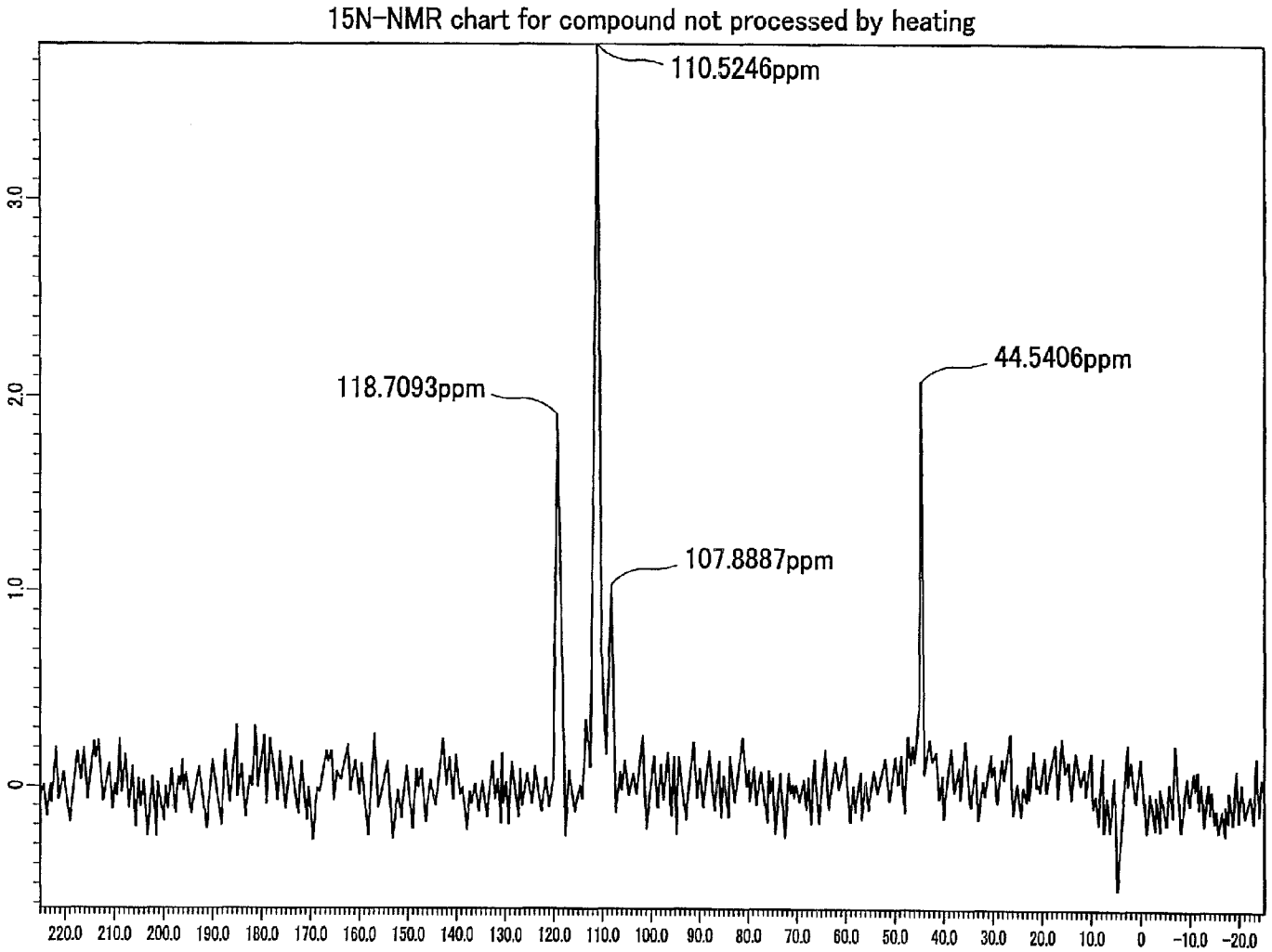
FIG. 6 is a $^{15}$N-NMR chart for the compound not processed by heating.

FIGS. 3 and 4 show results of analyses of the HMBC spectrum. FIGS. 5 and 6 show results of analyses of $^{15}$N-NMR. Table 2 below shows integrated values of δN in $^{15}$N-NMR. In measuring $^{15}$N-NMR, 0.5 ml of a sample was freeze-dried and added by 0.6 ml of DMSO-d6, and measurement was made using a measurement device JNM-ECA400 manufactured by JEOL Ltd.

TABLE 2

| | $^{15}$N-NMR δN integrated value | | | |
|---|---|---|---|---|
| heating time (hours) | near 45 ppm | near 108 ppm | near 111 ppm | near 119 ppm |
| none | 16 | 10 | 52 | 21 |
| 15 hours | 24 | none | 53 | 24 |

In the case of a compound obtained on processing by heating of the epichlorohydrin modified product for 15 hours, the correlation between carbon C of assignment 23 of adipic acid (173.3 ppm) and a proton of the assignment A of caprolactam (7.83 ppm) was noticed on the HMBC spectrum, as shown in FIGS. 3 and 5. It may thus be seen that it is NHR that is coupled to each end of the structure originating from adipic acid.

Also, the correlation between a proton of assignment C of diethylene triamine (8.24 ppm) and the carbon C of attribute 23 of adipic acid (173.3 ppm) or assignment 6 of caprolactam (172.1 ppm) was noticed on the HMBC spectrum. It may thus be seen that it is C═O that is coupled to each end N of the structure originating from diethylene triamine.

In addition, the correlation between a proton of epichlorohydrin (52.9 ppm) and the assignment 42 of diethylene triamine (3.2 ppm) was noticed on the HMBC spectrum. From this it may be seen that it is a structure originating from epichlorohydrin that is coupled to the center N of a structure originating from diethylene triamine, with the center N being a tertiary amine. It is observed that no peak was observed in the vicinity of 108 ppm on the $^{15}$N-NMR spectrum.

In the case of an epichlorohydrin modified product, not processed by heating, the correlation between carbon C of assignment 23 of adipic acid (173.3 ppm) and a proton of the assignment A of caprolactam (7.83 ppm) was noticed on the HMBC spectrum, as shown in FIGS. 4 and 6. From this it may be seen that it is NHR that is coupled to each end of the structure originating from adipic acid.

Also, the correlation between a proton of assignment C of diethylene triamine (8.24 ppm) and the carbon C of attribute 23 of adipic acid (173.3 ppm) or assignment 6 of caprolactam (172.1 ppm) was noticed on the HMBC spectrum. From this it may be seen that it is C═O that is coupled to each end N of the structure originating from diethylene triamine.

On the other hand, no correlation was noticed on the HMBC spectrum between the proton of 52.9 ppm of epichlorohydrin and the carbon C of the assigmnent 52 of diethylene triamine (2.86 ppm). From this it may be seen that it is not a structure originating from epichlorohydrin that is coupled to the center N of the structure originating from diethylene triamine. Further, a peak was noticed in the vicinity of 108 ppm originating from amide in the $^{15}$N-NMR spectrum. From this it may be seen that it is C═O that is coupled to the center N of the structure originating from diethylene triamine, with the center N being a tertiary amide.

From the above results of the structural analyses, it may be concluded that the compound having the structure of a tertiary amine, as shown by the above chemical formula (1), may be generated by processing by heating of the epichlorohydrin modified product.

(Time Duration of Processing by Heating and Molecular Weight)

The relationship between the time duration of processing by heating and the molecular weight of the compound prepared was then scrutinized.

The epichlorohydrin modified product was prepared in the manner as described above. The so prepared epichlorohydrin modified product (50 wt % aqueous solution) was processed by heating for a preset time duration in the manner as described above. That is, the epichlorohydrin modified product prepared was charged into a three-necked flask, to which a refluxing tube and a thermometer were attached. The three-necked flask was charged into a water bath of 96° C. and stirring was made with a stirrer. The reaction temperature of 96° C. was kept for a preset time duration as from the time when the temperature of the aqueous solution in the flask reached 96° C. The reaction system was heated under stirring. After lapse of the preset time duration, the flask was immediately charged into cold water to cool the aqueous solution in the flask to 25° C. The resulting aqueous solution was to be used as a sample. Meanwhile, as the preset time duration, zero time duration (no processing time), 3 hours, 6 hours, 10 hours or 15 hours were used.

The epichlorohydrin modified product samples, prepared as described above, were processed by heating for 3, 6, 10 and 15 hours to generate respective compounds, and the molecular weight of each of the compound samples was measured. The molecular weight of the epichlorohydrin modified product sample, not heated, was also measured. The molecular weight of each sample was measured by GPC (GelPermeation Chromatography) under measurement conditions as shown below. The measured results are shown in the following Table 3. In Table 3, Mw represents weight-average molecular weight, Mn represents number average molecular weight, and Mz represents Z-average molecular weight.

[Measurement Conditions]

GFC: PU-2085 plus type system manufactured by JASCO Corporation

Column: Asahipak GP-7M manufactured by SHOWA DENKO KK, HQ (7.5 mml, D×300 mL)

Eluent: 0.1M aqueous solution of NaCl/methanol=60/40

Flow rate: 0.5 mL/min

Detector: RI (40° C.)

Amount of injection: 10 μL

Standard specimens: polyethylene oxide (PEO) and ethylene glycol (EG)

Preparation of specimens: The specimen solution was dried to a solid state. A 1% aqueous solution was prepared using an eluent.

TABLE 3

| | | time of processing by heating (hours) | | | | |
|---|---|---|---|---|---|---|
| | | none | 3 | 6 | 10 | 15 |
| result of measurement | Mw | 3000 | 2550 | 2200 | 2000 | 1900 |
| | Mn | 680 | 670 | 660 | 650 | 650 |

TABLE 3-continued

| | | time of processing by heating (hours) | | | | |
|---|---|---|---|---|---|---|
| | | none | 3 | 6 | 10 | 15 |
| by GPC | Mz | 13000 | 10000 | 7000 | 5400 | 5100 |
| | Mw/Mn | 4.4 | 3.8 | 3.3 | 3.1 | 3.0 |

From the results of GPC measurements, shown in the above Table 3, it may clearly be seen that the longer the time of processing by heating, the smaller becomes the molecular weight of a compound. If the result of $^{15}$N-NMR measurements, referred to above, is also taken into consideration, it may be concluded that the processing by heating causes the tertiary amide of a networked compound of the epichlorohydrin modified product to be turned into a tertiary amine, thus causing the molecular weight to be decreased.

<Time and Temperature of Processing by Heating and Processing of Plating for a Circuit Board where a Blind Via Hole and a Through Hole Coexist>

The depth of a via recess and the throwing power (TP) for a through hole, obtained with a plating bath added by an epichlorohydrin modified product processed by heating under a preset condition, as a leveler, for a circuit board having both a blind via hole and a through hole, were evaluated. The depth of a via recess and the throwing power (TP) for a through hole, obtained with a plating bath added by an epichlorohydrin modified product not processed by heating, as a leveler, for the same board having both the blind via hole and the through hole, were also evaluated.

[Time of Processing by Heating]

Six different levelers were prepared as the conditions of processing by heating for the epichlorohydrin modified product were varied. Specifically, six epichlorohydrin modified product samples were prepared as different time durations of processing by heating of zero (no processing by heating), 3, 6, 10, 15 and 20 hours were used, with the reaction temperature being unchanged and kept at 96° C. One each of these six levelers was added to an electroplating bath to prepare six different electrolytic copper plating baths. Using these six electrolytic copper plating baths, the depth of via recesses and the throwing power (T) of the through holes as well as the covering power at the through hole corners (TH-C) were checked for the circuit board having both the blind via holes and through holes. Table 4 shows measured results. The leveler concentration was set to 10 mg/L. Other conditions for processing of electroplating and methods for evaluating the TP for the through hole as well as the covering power for the TP-C parts are indicated below. It is noted that the depth of the via recess is a measured value of depth of a part X shown in FIG. 7.

[Conditions for Electroplating]

The conditions for electroplating include the following:

copper sulfate pentahydrate: 250 g/L
sulfuric acid: 25 g/L
chloride ions: 50 mg/L
bis(3-sulfopropyl) disulfide (disodium salt) (SPS): 1.0 mg/L
polyethylene glycol (PEG) (average molecular weight, 6000): 300 mg/L
plating temperature: 25° C.
Dk (cathode current density): 1.0 ASD
plating time duration: 90 minutes (20 μm)

[Evaluation of TP]

Figure 8:
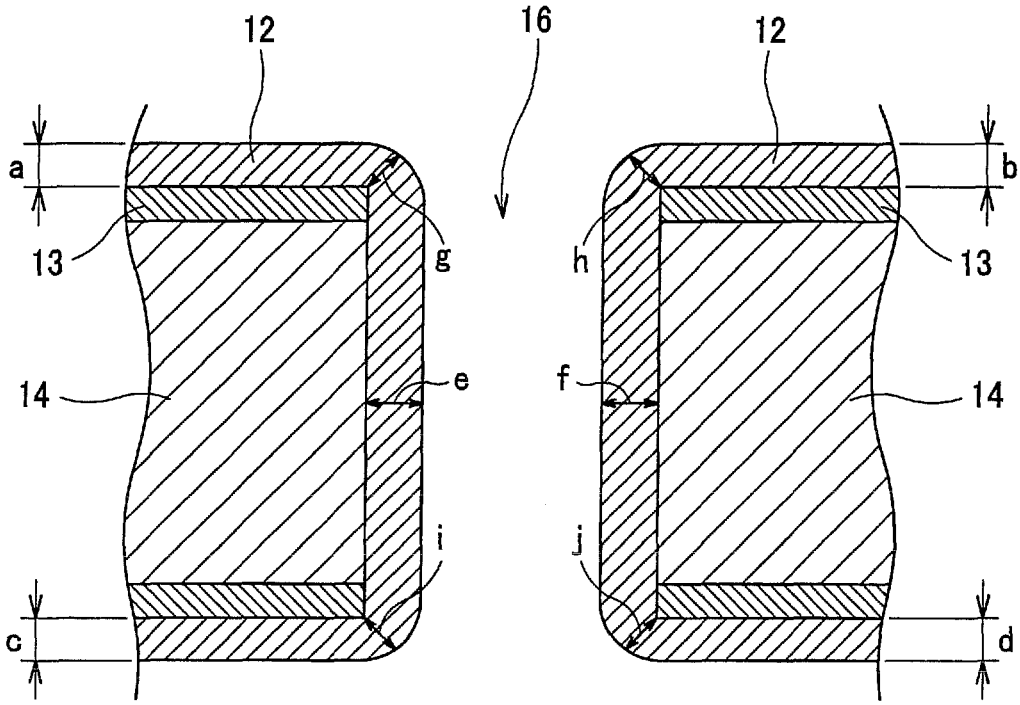
FIG. 8 is a cross-sectional view of a through hole taken for showing a site of measurement of a film thickness in evaluating the throwing power.

A through hole and a cross-section of a neighboring part thereof sliced out are as shown in FIG. 8. From the cross-sectional shape, the film thickness of a plating film at each of sites a to f was measured. From measured results, the throwing power was calculated in accordance with the equation:

$$TP(\%)=2(e+f)/(a+b+c+d)\times 100$$

Figure 7:
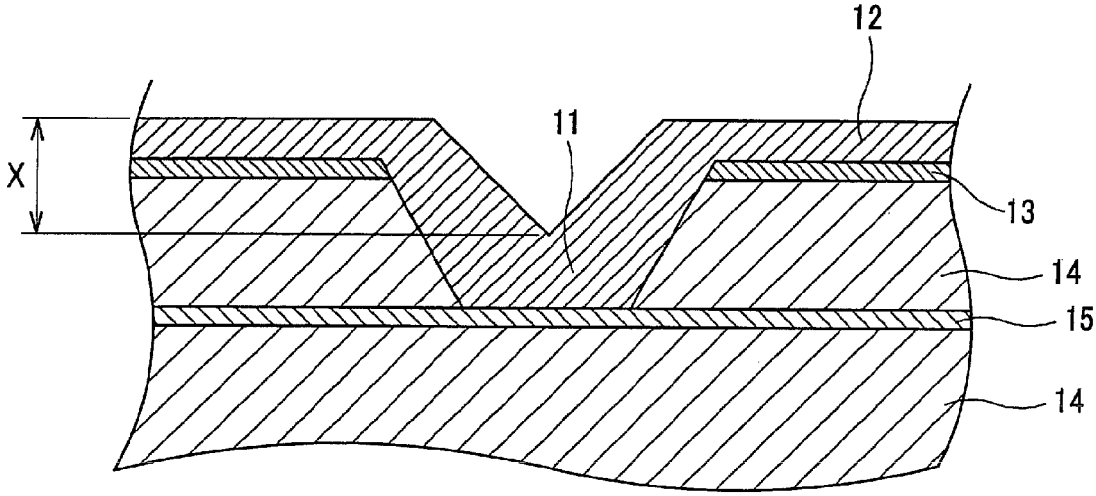
FIG. 7 is a cross-sectional view of a blind via hole for showing a site of measurement of a film thickness in evaluating the via recess depth.

It is noted that, in FIGS. 7 and 8, 11 denotes a blind via hole, 12 a plating film thickness, 13 a copper foil deposited on a surface, 14 a resin layer, 15 an inner copper foil and 16 a through hole. The film thicknesses of a plating film, indicated by e and f in FIG. 8, are those at a mid part of the through hole.

[Evaluation of the Covering Power at TH-C Part]

A through hole and a cross-section of a neighboring part thereof sliced out are as shown in FIG. 8. By observing the cross-sectional shape, the film thicknesses of a plating film at sites a to f were measured. From measured results, the covering power was calculated in accordance with the equation:

$$TH\ \text{corner}(\%)=(g+h+i+j)/(a+b+c+d)\times 100$$

It is noted that, in FIG. 8, the film thicknesses of the plating film, indicated by g to j, are those of the plating film portions formed at corner parts of the through hole, that is, the plating film thicknesses at positions of 135° relative to the lateral side of the through hole.

TABLE 4

| | time of processing by heating (hrs) | | | | | |
|---|---|---|---|---|---|---|
| | none | 3 | 6 | 10 | 15 | 20 |
| via recess (μm) | 35.4 | 25.1 | 15 | 8.9 | 8.7 | 8.8 |
| TH (TP) | 75% | 74% | 74% | 76% | 77% | 76% |
| TH (TH-C) | 75% | 74% | 75% | 74% | 75% | 75% |

In the above Table 4, in the case of a plating bath added by the compound not processed with heating, as a leveler, the depth of the via recess was as much as 35.4 μm. On the other hand, with the plating bath added by the compound obtained on processing by heating, the depth of the via recess was 25.1 μm even though the time duration of processing by heating was 3 hours. The difference in the via recess depth was in excess of 10 μm as compared to that obtained with the bath containing the unheated compound as the leveler. The longer the time duration of the processing by heating, the greater becomes the via recess depth and the greater becomes the difference from the via recess depth obtained with the bath containing the unheated compound as the leveler. In particular, if the leveler obtained on processing by heating for 10 hours or longer, the via recess depth could be reduced to 8.9 μm or less.

It is observed that the throwing power (TP) of the through hole was scarcely changed with the time duration of processing by heating. However, for any processing time duration, the covering power for the through hole was satisfactory. Moreover, at the corner part of the through hole, the throwing power was scarcely changed and the satisfactory covering power was displayed.

(Temperature for Processing by Heating)

Then, for each of the time durations of processing by heating of 10 hours and 15 hours, the relationship between the temperature of processing by heating on one hand and the via recess depth in throwing power (TP) for the through hole and the covering power for the through hole corner (TH-C) part in a circuit board having both the blind via holes and through holes were scrutinized. The temperatures for the processing by heating were set to 80, 90, 93 and 96° C. The same conditions for electroplating as those mentioned above were used. Table 5 shows the measured results for the case where the time duration of processing by heating was set to 10 hours, and Table 6 shows those for the case where the time duration of processing by heating was set to 15 hours.

TABLE 5

| | temperature for processing by heating (° C.) | | | |
|---|---|---|---|---|
| | 80 | 90 | 93 | 96 |
| via recess depth (μm) | 25.3 | 22.7 | 16.9 | 8.9 |
| TH (TP) | 75% | 76% | 74% | 76% |
| TH (TH-C) | 74% | 73% | 74% | 76% |

TABLE 6

| | temperature for processing by heating (° C.) | | | |
|---|---|---|---|---|
| | 80 | 90 | 93 | 96 |
| via recess depth (um) | 25.3 | 12.5 | 9.1 | 8.7 |
| TH (TP) | 74% | 75% | 77% | 76% |
| TH (TH-C) | 76% | 75% | 77% | 75% |

From Tables 5 and 6, it may be seen that the higher the temperature for processing by heating, the smaller may be the via recess depth for each of the cases of the processing time durations of 10 and 15 hours.

Specifically, with the processing time duration of 10 hours, the via recess depth may be equal to or less than 29.5 μm for the temperature for processing by heating of 80° C. or higher. The via recess depth may thus be reduced appreciably in comparison with the case of using the compound not processed by heating. In particular, in case the temperature for processing by heating is 96° C., the via recess depth could be reduced to very small values of 8.9 μm.

Specifically, with the processing time duration of 15 hours, the via recess depth may be made equal to or less than 25.3 μm for the temperature for processing by heating of 80° C. or higher. The via recess depth may thus be reduced appreciably in comparison with the case of using the compound not processed by heating. In particular, in case the temperature for processing by heating was 93° C. and 96° C., the via recess depth could be reduced to very small values of 9.1 μm and 8.7 μm, respectively.

From this it is seen that, in case the time of processing by heating is set to 10 hours, the via recess depth equal to or less than 10 μm may be obtained by carrying out the processing for heating at a temperature equal to or higher than 96° C. It is also seen that, in case the time of processing by heating is set to 15 hours, the via recess depth equal to or less than 10 μm may be obtained by carrying out the processing for heating at a temperature equal to or higher than 93° C. It is further seen that, by carrying out the processing for heating at a temperature condition of 96° C., it is possible to prepare a leveler that allows for efficiently improving the via plugging property with a short processing time duration of ten hours.

Meanwhile, the throwing power (TP) for the through hole was scarcely varied with the temperatures of processing for heating. However, for any processing temperatures used, a satisfactory covering power was demonstrated for the through hole. As for the through hole corner parts, the throwing power again scarcely shows differences depending on the temperature for processing by heating. The covering power displayed was satisfactory for any processing temperature used.

Comparative Examples

For the following Comparative Examples, measurements were made of the via recess depth, throwing power (TP) for the through hole and the covering power for the through hole corner (TH-C) in a circuit board having both blind via holes and through holes.

In Comparative Example 1, processing for electrolytic copper plating was carried out under the same electroplating conditions as those set out above except that 0.1 mg/L of polyethylene imine, with an average molecular weight of 600, as a copolymer of secondary and tertiary amines, was contained as a leveler in the electroplating bath. Meanwhile, as this polyethylene imine, a product manufactured by NIPPON SHOKUBAI Co. Ltd. under the trade name of EPOMIN SP-006 was used.

In Comparative Example 2, processing for electrolytic copper plating was carried out under the same electroplating conditions as those set out above except that 10 mg/L of polyglutamic acid, as a poly secondary amide, was contained as a leveler in the electroplating bath. As polyglutamic acid, a product prepared by MP BIOMEDICALS was used.

In a Comparative Example 3, processing for electrolytic copper plating was carried out under the same electroplating conditions as those set out above except that 10 mg/L of PO modified polyethylene imine, as a poly tertiary amide, was contained as a leveler in the electroplating bath. As the PO modified polyethylene imine, a product prepared by NIPPON SHOKUBAI Co. Ltd. under the trade name of EPOMIN PP01 was used.

In a Comparative Example 4, measurements were made of the via recess depth, throwing power (TP) for the through hole and the covering power for the through hole corner part (TH-C) in a circuit board having both blind via holes and through holes. Measured results are shown in Table 8.

[Electroplating Conditions]

The conditions for electroplating include the following:

copper sulfate pentahydrate: 250 g/L
sulfuric acid: 25 g/L
chloride ions: 50 mg/L
bis(3-sulfopropyl) disulfide (disodium salt) (SPS): 1.0 mg/L
polyethylene glycol (PEG) (average molecular weight, 6000): 300 mg/L
Janus green black (JGB): 1.0 mg/L
plating temperature: 25° C.
Dk (cathode current density): 1.0 ASD
plating time duration: 90 minutes (20 μm)

Table 7 shows measured results of the via recess depth in each Comparative Example.

TABLE 7

| | Comp. Ex. 1 | Comp. Ex. 2 | Comp. Ex. 3 | Comp. Ex. 4 |
|---|---|---|---|---|
| via recess depth (μm) | 72 | 45 | 6 | 7.5 |
| TH (TP) | 70% | 45% | 66% | 21% |
| TH (TH-C) | 57% | 51% | 45% | 5% |

In the above Table 7, the via recess depth was not less than 45 μm, in each of the Comparative Examples 1 to 3, such that plating could not be plugged in the blind via hole. Turning to the covering power of the plating film for the through hole, the throwing power for the through hole of Comparative Example 1 was of a relatively high value of 70%. However, it is seen that, in case of using plating baths of Comparative Examples 1 to 3, the covering power is lower than in case of using the plating bath shown in Tables 4 to 6 according to the present invention. It is also seen that the covering power at the through hole corner part is 45 to 57% for the Comparative Examples 1 to 3, thus being of extremely low values as compared to those with the case of using the plating bath according to the present invention.

In Comparative Example 4, the via recess depth was 7.5 μm, and hence the satisfactory via plugging property was achieved. However, the throwing power (TP) for the through hole was extremely low and was 21%. The covering power for the through hole corner part was only 5%. In the electroplating bath, used in Comparative Example 4, plating can be plugged satisfactorily in the blind via hole in a circuit board having both the blind via holes and through holes. However, it is seen that, in the electroplating bath of the Comparative Example 4, no sufficient covering power may be achieved for the through hole, such that only a circuit board of inferior quality is formed.

It should be understood by those skilled in the art that various modifications, combinations, sub-combinations and alterations may occur depending on design requirements and other factors insofar as they are within the scope of the appended claims or the equivalents thereof.

What is claimed is:

1. An electrolytic copper plating bath containing a water-soluble copper salt, sulfuric acid and chloride ions, as main components, and a compound represented by the following chemical formula (1):

(1)

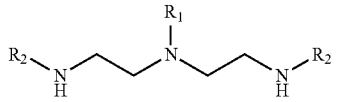

in which $R_1$ is represented by the following chemical formula (2) or (3):

(2)

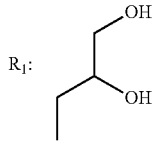

(3)

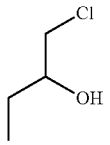

$R_2$ is represented by the following chemical formula (4)

(4)

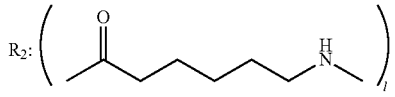

-continued

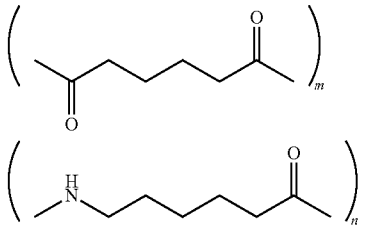

l denotes an integer not less than 0;

m denotes 1; and n denotes an integer not less than 0, wherein the compound represented by the chemical formula (1) is generated by converting an amide to an amine by heating an amide containing compound represented by the following chemical formula (5):

(5)

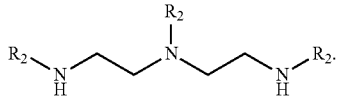

2. The electrolytic copper plating bath according to claim 1, wherein the compound represented by the chemical formula (5) is an epichlorohydrin modified product of a polycondensation product of diethylene triamine, adipic acid and ε-caprolactam.

3. The electrolytic copper plating bath according to claim 1, further containing a sulfur-containing compound selected from the group consisting of compounds of the chemical formulas (6) to (9):

(6)

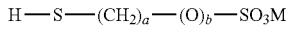

(7)

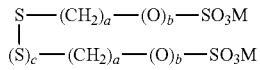

(8)

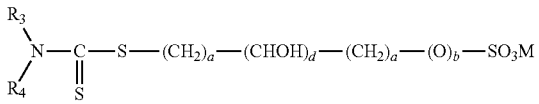

(9)

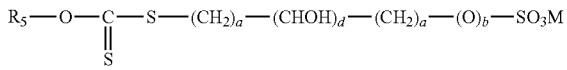

where $R_3$, $R_4$ and $R_5$ each denote an alkyl group with two or three carbon atoms, M denotes a hydrogen atom or an alkali metal, a denotes integers from 1 to 8, and b to d each denote 0 or 1.

4. The electrolytic copper plating bath according to claim 3, further containing a polyalkylene glycol represented by the chemical formula (10):

$$HO—(R_6—O)_e—H \quad (10)$$

where $R_6$ denotes an alkylene group having two or three carbon atoms and e denotes an integer not less than four, or a derivative thereof.

5. The electrolytic copper plating bath according to claim 4, wherein the polyethylene glycol is a polyethylene glycol, polypropylene glycol or a copolymer of ethylene glycol and propylene glycol.

6. A method for electrolytic copper plating comprising:

immersing an article to be plated, having both a through hole and a blind via hole, in an electrolytic copper plating bath containing a water-soluble copper salt, sulfuric acid and chloride ions, as main components, and a compound represented by the following chemical formula (1):

(1)

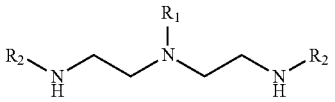

in which $R_1$ is represented by the following chemical formula (2) or (3):

(2)

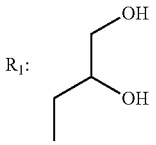

(3)

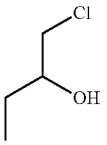

$R_2$ is represented by the following chemical formula (4)

(4)

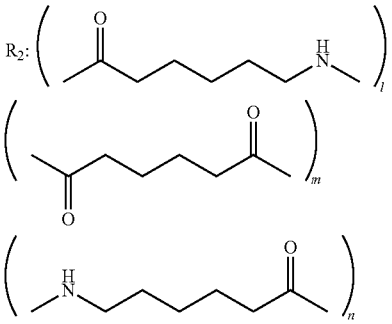

l denotes an integer not less than 0;

m denotes 1; and n denotes an integer not less than 0; and carrying out electroplating, with said article to be plated as a cathode, to effect plating of the inside of said through hole and the inside of said blind via hole simultaneously, wherein the compound represented by the chemical formula (1) is generated by converting an amide to an amine by heating an amide containing compound represented by the following chemical formula (5):

(5)

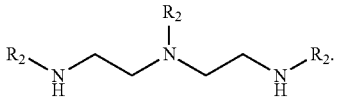

7. The method according to claim 6, wherein the compound represented by the chemical formula (5) is an epichlorohydrin modified product of a polycondensation product of diethylene triamine, adipic acid and ϵ-caprolactam.

8. The method according to claim 6, further containing a sulfur-containing compound selected from the group consisting of compounds of the chemical formulas (6) to (9):

(6)

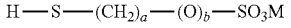

(7)

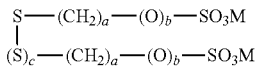

(8)

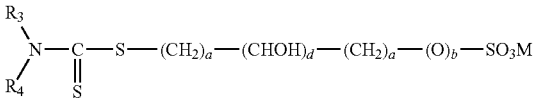

(9)

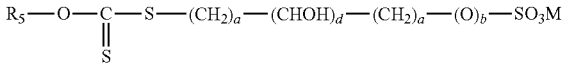

where $R_3$, $R_4$ and $R_5$ each denote an alkyl group with two or three carbon atoms, M denotes a hydrogen atom or an alkali metal, a denotes integers from 1 to 8, and b to d each denote 0 or 1.

9. The method according to claim 8, further containing a polyalkylene glycol represented by the chemical formula (10):

$$HO—(R_6—O)_e—H \quad (10)$$

where $R_6$ denotes an alkylene group having two or three carbon atoms and e denotes an integer not less than four, or a derivative thereof.

10. The method according to claim 9, wherein the polyethylene glycol is a polyethylene glycol, polypropylene glycol or a copolymer of ethylene glycol and propylene glycol.

11. The electrolytic copper plating bath according to claim 2, further containing a sulfur-containing compound selected from the group consisting of compounds of the chemical formulas (6) to (9):

(6)

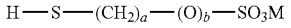

(7)

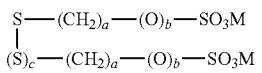

(8)

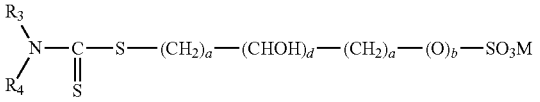

-continued (9)

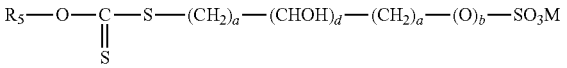

where $R_3$, $R_4$ and $R_5$ each denote an alkyl group with two or three carbon atoms, M denotes a hydrogen atom or an alkali metal, a denotes integers from 1 to 8, and b to d each denote 0 or 1.

12. The electrolytic copper plating bath according to claim 1, wherein the compound shown by the above formula (1) has been generated by processing by heating of the compound shown by the above chemical formula (5) at a temperature not lower than 93 ° C. for not less than 10 hours.

13. The method according to claim 6, wherein the compound shown by the above formula (1) has been generated by processing by heating of the compound shown by the above chemical formula (5) at a temperature not lower than 93° C. for not less than 10 hours.

14. The electrolytic copper plating bath according to claim 1, wherein the amide comprises a tertiary amide and the amine comprise a tertiary amine.

15. The method according to claim 6, wherein the amide comprises a tertiary amide and the amine comprise a tertiary amine.

16. The method according to claim 6, wherein the heating forms the compound represented by the chemical formula (1) through the converting of the amide to the amine, wherein the compound has a number average molecular weight reduced to less than 670 grams per mole.

* * * * *